US005330622A

United States Patent [19]

Honnorat et al.

[11] Patent Number: 5,330,622

[45] Date of Patent: Jul. 19, 1994

[54] COMPOSITION FOR RENDERING A PAPER OR TEXTILE BASE RESISTANT TO WATER, OIL AND SOLVENTS, TREATED BASE AND PROCESS FOR THE PRODUCTION OF THE TREATED BASE

[75] Inventors: André Honnorat, Annecy; Claude Riou, Menthon Saint Bernard, both of France

[73] Assignee: Aussedat-Rey, Velizy Villacoublay, France

[21] Appl. No.: 918,073

[22] Filed: Jul. 24, 1992

[30] Foreign Application Priority Data

Jul. 25, 1991 [FR] France ..... 91 09693

[51] Int. Cl.[5] ..... D21H 17/72

[52] U.S. Cl. ..... 162/135; 8/116.4; 8/181; 106/243; 106/287.24; 106/287.28; 162/158; 162/179; 427/394; 427/395

[58] Field of Search ..... 162/135, 158, 164.1, 162/179, 157.6; 106/243, 287.24, 287.28; 8/181, 116.4; 427/395, 394

[56] References Cited

U.S. PATENT DOCUMENTS

| | | | |
|---|---|---|---|
| 2,285,490 | 6/1942 | Broderick | 162/158 |
| 2,622,960 | 12/1952 | Woods et al. | 162/158 |
| 3,069,311 | 12/1962 | Harpham | 162/157.6 |
| 3,736,164 | 5/1973 | Uffner | 106/287.27 |
| 3,810,772 | 5/1974 | Uffner | 106/287.27 |
| 3,953,283 | 4/1976 | Wing et al. | 162/158 |
| 4,536,254 | 8/1985 | Falk et al. | 162/158 |

*Primary Examiner*—Peter Chin
*Attorney, Agent, or Firm*—Bacon & Thomas

[57] ABSTRACT

Coating and impregnation of bases.

The invention relates to a composition for impregnating a base, more particularly a paper or textile base, said composition being intended to provide said base with barriers, especially at least hydrophobic barriers, and including glyoxal, the composition also being intended to provide oleophobic and solvanophobic properties simultaneously and comprising the following, by weight of dry product relative to the base:

at least 0.03% of glyoxal, at least 0.01% of a dimeric alkylketen and at least 0.002% of a fluorinated salt selected from the family of the diethanolamine salts of perfluoroalkyl ethyl phosphates.

Composition for rendering a paper or textile base hydrophobic, oleophobic and solvanophobic.

17 Claims, No Drawings

COMPOSITION FOR RENDERING A PAPER OR TEXTILE BASE RESISTANT TO WATER, OIL AND SOLVENTS, TREATED BASE AND PROCESS FOR THE PRODUCTION OF THE TREATED BASE

The present invention concerns the general technical field of the coating and impregnation of all kinds of bases with a view to providing the latter with properties of resistance or reaction to a specific agent.

The present invention relates to a composition for coating and/or impregnating a base with a view to providing said base with combined properties of resistance to water, oil and solvents, said properties hereafter being referred to as properties of hydrophobicity, oleophobicity and solvanophobicity. The invention further relates to the bases treated with the composition and to the process for the treatment of the base with said composition.

Within the framework of the invention, bases should be understood as meaning all types of bases or substrates which have a good porosity and for which properties of hydrophobicity, oleophobicity and solvanophobicity are sought. Preferentially, but not exclusively, the invention relates to paper or textile bases or substrates. In the latter case, woven fabric bases can be made from a diversity of synthetic and/or natural fibers.

In one of the preferential desired applications, namely in the field of papermaking, papers which have so-called barrier effects, and which are commonly called barrier papers for this reason, have been sought for a long time. There are currently several kinds of barrier papers in existence which are obtained by the conventional coating technique and whose barrier properties are also varied and related to the composition with which the base is coated.

Among the different types of barrier papers currently available, it is already known to coat a base paper, which may already have been treated for resistance to grease, with a latex-based composition. Thus, in French patent application A-2 365 002, provision is made to treat a paper base so as to render it resistant to water and water vapor by coating it with a composition containing equal amounts of acrylostyrene latex and an aqueous dispersion of a metal salt such as calcium stearate. U.S. Pat. No. 2,453,380 has already described treating the inside of cardboard containers with a coating containing a mixture of latex, wax to which a filler such as zinc stearate or zinc oxide may have been added, and soap, so as to provide a non-stick coating for a plasticized organic polymer. Canadian patent 870 055 describes a composition for rendering bases based on vinyl ester or latex-based resin hydrophobic, said composition being based on calcium, magnesium, barium or aluminum stearate in combination with a triethanolamine stearate or oleate. It has moreover already been envisaged to produce coating compositions based on a mixture of latex with a fluorinated product or chromium salts which may or may not be combined with a polyvinyl alcohol.

In all the above-mentioned cases, such compositions can be considered satisfactory for the barrier properties which they are supposed to give the base on which they are coated, their prime disadvantage being the monofunctional nature of their barrier properties, which is restricted essentially to a hydrophobic function. It is also generally considered that the bases coated with such compositions have an inadequate porosity to air, which represents a major disadvantage in certain applications.

It is also known in the prior art to improve the resistance to water of certain bases by incorporating a glyoxal-based composition into the coating composition. Thus French patent application B-1 527 721 proposes the use of glyoxal-containing polymers for improving the wet strength of a paper. It is also known, from European patent application A-0 187 673, to improve the water resistance properties of paper bases by impregnating them with a composition based on a polyvinyl alcohol associated with an aldehyde such as glyoxal. Such compositions can also be considered satisfactory if the paper base is to be provided only with the property of hydrophobicity.

In the particular technical field of the production of particle board, it is known from European patent application A-0 327 215 to improve the adhesive bonding of the cellulose fibers whilst at the same time providing the resulting product with hydrophobic properties. To do this, it is proposed to treat the product with a composition containing a mixture which includes a resin based on a dimeric alkylketen, and a hydrophobic agent such as a wax.

It must therefore be considered that, despite there being a large number of commercially available products for individually confering either resistance to water or resistance to grease or even, in certain cases, resistance to solvents, there are no compounds capable of providing a paper or textile base with these various properties simultaneously.

One object of the present invention is consequently to provide a composition capable of giving a base hydrophobic, oleophobic and solvanophobic properties whilst at the same time making it possible for the treated base to retain a high porosity to air.

A further object of the invention is to provide a treatment composition capable of treating any base indiscriminately, especially paper or textile bases.

A further object of the invention is to provide a composition whose application is particularly simple and can be effected simply by coating the paper with the aid of a size press.

Finally, a complementary object of the invention is to provide a composition which tolerates mixing with the conventional paper or textile additives without detraction from the barrier properties obtained and without the appearance of undesirable effects.

The objects assigned to the invention are achieved by means of a composition for impregnating a base, more particularly a paper or textile base, said composition being intended to provide said base with barrier properties, especially at least hydrophobic properties, and including glyoxal, the composition also being intended to provide oleophobic and solvanophobic properties simultaneously and comprising the following, by weight of dry product relative to the base:

at least 0.03% of glyoxal, at least 0.01% of a dimeric alkylketen and at least 0.002% of a fluorinated salt selected from the family of the diethanolamines of perfluoroalkyl ethyl phosphates.

The objects assigned to the invention are also achieved by means of a process for the impregnation of a base with a composition, which consists in applying the composition with the aid of an impregnating press.

The impregnating composition according to the invention is intended to provide the base with hydrophobic, oleophobic and solvanophobic properties simultaneously and, to this end, comprises an association of glyoxal, a dimeric alkylketen and a fluorinated salt selected from the family of the diethanolamine salts of perfluoroalkyl ethyl phosphates.

The association of these three components is capable of forming a composition which can be applied to any bases which are to possess hydrophobic, oleophobic and solvanophobic barrier properties. However, the composition is more particularly intended to be applied to paper or textile bases. Such a base can be partially or totally made up of synthetic fibers such as, for example, polyester or nylon, or natural fibers such as cotton, viscose, a linen/viscose blend or cellulose, or else a blend of synthetic and natural fibers of the cellulose/-polyester type (synthetic paper) or cotton/polyester type.

The glyoxal which is used preferentially within the framework of the invention is glyoxal 40T manufactured by HOECHST, which is a 40% solution. It is obvious that a different concentration of the product can be used without departing from the framework of the invention.

The minimum amount of glyoxal in the admixture, defined as the weight of dry product relative to the base, is 0.03%, this minimum dose in the admixture being particularly suitable for a woven fabric base, whereas for a paper base the minimum dose is 0.15%. Irrespective of the type of base in question, the optimum and preferential dose is 0.8%, the maximum dose being determined simply by the economic requirements in conjunction with the desired effects.

The commercial dimeric alkylketen polymer is chosen as a function of the pH of the solution of fluorinated agent which it is desired to introduce, and as a function of subsidiary criteria such as the availability or the cost price. By way of example, the dimeric alkylketen polymers known as AQUAPEL 360 XV and AQUAPEL 34, marketed by HERCULES, are suitable.

The minimum amount of dimeric alkylketen polymer in the admixture, expressed as the weight of dry product relative to the base, is 0.01% for a woven fabric base and 0.05% for a paper base, the preferential optimum dose being 0.3%. In the same way as for the glyoxal, a maximum dose is not necessary. The maximum amount incorporated is a function of the amounts of the other components introduced and the desired objective.

The fluorinated component which can be used varies according to the desired degree of resistance to grease, solvents or water. In all cases, the fluorinated salt is selected from the family of the diethanolamines, and in particular from the diethanolamine salts of mono- and bis-(1H,1H,2H,2H-perfluoroalkyl ethyl) phosphates, the alkyl group being in the $C_8$ to $C_{18}$ range. Of the family defined in this way, the fluorinated agents which are selected preferentially are the diethanolamine salts of perfluoroalkyl ethyl phosphates as a 33% solution in isopropanol, said solution being marketed by HOECHST France under the name HOES 2746. Other fluorinated products might also be suitable and prove compatible with the other products in the composition, but the water resistance results or the combined barrier effects are inferior.

The amount of fluorinated product incorporated into the composition, expressed as the weight of dry product relative to the base, can be very low on account of its good efficacy. A minimum dose of 0.002% is particularly suitable for a woven fabric base, whereas for a paper base the minimum dose is 0.01%. In both cases, the preferential optimum dose is 0.35%. A maximum dose has not been demonstrated, the upper limit of incorporation being dictated by the cost and efficacy of the product. However, it has been noted that, depending on the nature of the base, the resistance to grease and solvents no longer improves beyond a limiting level of incorporation.

Apart from the three basic products mentioned above, it is quite obviously possible to include conventional paper or textile additives in the composition, provided, of course, that they are compatible with the composition. By way of a non-limiting Example, it is thus possible to include, either by themselves or in combination, viscosity-improving agents or thickeners such as polyvinyl alcohols or starch, antifoams, disperse waxes, mineral fillers and spreading additives.

The association of the three basic products mentioned can be considered to be novel and results in synergistic effects between the three constituents, confering barrier properties in respect of all solvents and oily and aqueous agents whilst at the same time allowing the treated base to retain a good porosity to air. It has been found, for example, that the barrier effect towards water is significantly greater than the effects which could be achieved by an equivalent amount of each product present in the composition, but taken separately.

The process for the impregnation of the papertype base with a composition according to the invention consists in applying the composition with the aid of an impregnating press, which can be for example a size press, an impregnator or a roller system. The impregnation will preferentially be carried out with the aid of a size press and it should moreover be pointed out that, in contrast to the difficulties, well known to those skilled in the art and encountered prior to the invention, of adding the oleophobic and hydrophobic barrier effects with two different products using a size press, the composition according to the invention makes it possible precisely to add the three desired effects synergistically by way of said impregnation. The impregnation process using the impregnating press will be carried out so that the composition penetrates thoroughly into the base, thereby confering the barrier properties throughout the entire thickness of the base.

The textile-type bases can be impregnated by means of roller systems, as described previously, or by a technique of direct immersion in the treatment composition.

The properties resulting from the treatment are evaluated by the following standardized methods:

- penetration of water: COBB method defined according to the Standard AFNOR NF Q 03-018, given that a base treated by the size press technique has good hydrophobic properties according to the COBB method if the value obtained is below 13;
- penetration of solvents and oils: 3M method defined according to the procedure TAPPI UM 557 and carried out by the so-called KIT TEST process;
- porosity of the base to air: Standard AFNOR NF Q 03-001.

EXAMPLE 1

Using a size press of trademark DIXON, claimed composition 1 and reference compositions 2, 3, 4 and 5 below are applied to a paper sized with a rosin (acid medium), containing no mineral filler, weighing 45 g/m$^2$and refined to 40° SR.

The amounts deposited, in % of the dry products relative to the weight of the base, are as follows:

COMPOSITION 1: 0.5% of AQUAPEL 360 XV (dimeric alkylketen marketed by HERCULES) 1.5% of fluorinated salt HOES 2746 (HOECHST) 1.2% of GLYOXAL 40T (HOECHST)

COMPOSITION 2: AQUAPEL 360 XV in commercial form (HERCULES), i.e. 1.4%

COMPOSITION 3: 3% of fluorinated salt HOES 2746 (HOECHST)

COMPOSITION 4: 1.5% of fluorinated salt HOES 2746 (HOECHST)

COMPOSITION 5: GLYOXAL 40T in commercial form (i.e. a weight of 8% deposited on the paper)

The results obtained are given in Table 1 below:

TABLE 1

| | COBB 1 min | KIT TEST |
|---|---|---|
| COMPOSITION 1: | 10.5 | 8 |
| COMPOSITION 2: | 12.9 | 0 |
| COMPOSITION 3: | 19.3 | 12 |
| COMPOSITION 4: | 16.8 | 9 |
| COMPOSITION 5: | 16.2 | 0 |

EXAMPLE 2

Composition 1 mentioned above is coated on to an unsized, unfilled and moderately refined base paper weighing 112 g/m$^2$.

The results are given in Table 2.

EXAMPLE 3

Composition 1 above is coated on to a base paper weighing 51 g/m$^2$, containing a small amount of size, filled with calcium carbonate and having a low degree of refining.

The results are given in Table 2.

EXAMPLE 4

Composition 1 above is coated on to a base paper weighing 72 g/m$^2$, containing a very large amount of rosin size, filled with talc and having a low degree of refining.

The results are given in Table 2.

EXAMPLE 5

Composition 1 above is deposited on to an unfilled base paper weighing 203 g/m$^2$, bulk sized with AQUAPEL, treated with SCOTCHBAN FC 807 (product of 3M) and having a low degree of refining.

The results are given in Table 2.

TABLE 2

| COATING OF DIFFERENT BASES WITH COMPOSITION 1 | | AFNOR POROSITY | COBB 1 min | KIT TEST |
|---|---|---|---|---|
| EXAMPLE 1 | BASE: (Untreated control) | 0.13 | 18.5 | 0 |
| | COATED PAPER: | 0.08 | 10.5 | 8 |
| EXAMPLE 2 | BASE: (Untreated control) | 3.5 | 158 | 0 |
| | COATED PAPER: | 2.3 | 8.2 | 12 |
| EXAMPLE 3 | BASE: (Untreated control) | 8.3 | 54.5 | 0 |
| | COATED PAPER: | 5.6 | 7.5 | 5 |
| EXAMPLE 4 | BASE: (Untreated control) | 9.6 | 14.9 | 0 |
| | COATED PAPER: | 7.2 | 7.8 | 6 |
| EXAMPLE 5 | BASE: (Untreated control) | 14.2 | 19.6 | 8 |
| | COATED PAPER: | 14.5 | 12.1 | 10 |

EXAMPLE 6

The following composition, which corresponds, in percentages of the dry products relative to the paper, to:

AQUAPEL 360 (HERCULES): 0.25%

HOES 2746 (HOECHST) : 0.45%

GLYOXAL 40T (HOECHST): 0.6%, is applied by means of a DIXON machine to the base described in Example 1.

The results are as follows: COBB: 10.4

KIT TEST: 3

EXAMPLE 7

Composition 1 described above is applied to the base described in Example 5 with the aid of a size press of a test machine (at a speed of 50 m/min).

This test machine leads to a greater bath uptake penetrating the paper more thoroughly than the DIXON machine used in Examples 1 to 6, corresponding to the following amounts:

0.75% of AQUAPEL 360 XV (dimeric alkylketen marketed by HERCULES)

2.3% of fluorinated salt HOES 2746 (HOECHST)

1.8% of GLYOXAL 40T (HOECHST).

The results are: COBB: 10.7 KIT TEST: 12

EXAMPLE 8

The following composition is applied to the base described in Example 1 with the aid of the test machine at a speed of 50 m/min:

AQUAPEL 360 (HERCULES): 0.43% BY WEIGHT

GLYOXAL 40T (HOECHST): 1% RELATIVE TO THE

HOES 2746 (HOECHST) : 1.5% BASE

The results are: COBB: 9.4

KIT TEST: 9

EXAMPLE 9

The following composition is applied to the base described in Example 1 with the aid of the test machine at a speed of 50 m/min:

AQUAPEL 360 (HERCULES): 0.5% BY WEIGHT

GLYOXAL 40T (HOECHST): 1.2% RELATIVE TO THE

HOES 2746 (HOECHST) : 0.9% BASE The results are: COBB: 8.8

KIT TEST: 7

EXAMPLE 10

COMPOSITION 1 described in Example 1 is deposited with the aid of a DIXON machine on to an unsized, unfilled non-woven base made up of 50% of cellulose fibers and 50% of polyester fibers (consisting of 90% of 18 mm long fibers of 1.7 dtex and 10% of 38 mm fibers of 16 dtex). The results are as follows:

| | AFNOR POROSITY | COBB 1 min | KIT TEST |
|---|---|---|---|
| UNTREATED BASE | 89 | 148 | 0 |
| COATED BASE | 51 | 8.4 | 12 |

The results are given in Table 3.

The results are measured either after treatment of the fabric or after a treatment followed by washing of the fabric with a solid soap having the following composition:

tallow base, palm oil, fatty acid distilled from 25% vegetable oil including soya, colza, maize, sunflower, groundnut) with 2% of glycerol added.

TABLE 3

EXAMPLE 12

CHANGE IN THE HYDROPHOBICITY:

| WOVEN FABRIC | HOES 2746 % DRY PRODUCT | GLYOXAL % DRY PRODUCT | AQUAPEL 360 % DRY PRODUCT | COBB UNCOATED | COBB COATED | COBB AFTER WASHING |
|---|---|---|---|---|---|---|
| POLYESTER 100% | 0.17 | 0.13 | 0.05 | 234 | 160 | 30.4 |
| NYLON 100% | 0.11 | 0.08 | 0.03 | 18.3 | 12.6 | 1.9 |
| VISCOSE 100% | 0.17 | 0.13 | 0.05 | 59 | 34 | 2.7 |
| COTTON 100% | 0.23 | 0.17 | 0.07 | 425 | 10.3 | 29.5 |
| LINEN 20% - VISCOSE 80% | 0.3 | 0.22 | 0.09 | 247 | 106 | 22.2 |
| COTTON 35% - POLYESTER 65% | 0.15 | 0.11 | 0.04 | 196 | 67 | 19.4 |

CHANGE IN THE OLEOPHOBICITY:

| WOVEN FABRIC | HOES 2746 % DRY PRODUCT | GLYOXAL % DRY PRODUCT | AQUAPEL 360 % DRY PRODUCT | KIT TEST UNCOATED | KIT TEST COATED |
|---|---|---|---|---|---|
| POLYESTER 100% | 0.17 | 0.13 | 0.05 | 0 | 12 |
| NYLON 100% | 0.11 | 0.08 | 0.03 | 0 | 12 |
| VISCOSE 100% | 0.17 | 0.13 | 0.05 | 0 | 12 |
| COTTON 100% | 0.23 | 0.17 | 0.07 | 0 | 9 |
| LINEN 20% - VISCOSE 80% | 0.3 | 0.22 | 0.09 | 0 | 9 |
| COTTON 35% - POLYESTER 65% | 0.15 | 0.11 | 0.04 | 0 | 9 |

EXAMPLE 11

The standardized paper tests described above are performed on a 100% cotton woven fabric weighing g/m$^2$ and serving as an impregnation base, after immersion in the solutions indicated below. The results are as follows:

| | COBB 1 min | KIT TEST |
|---|---|---|
| 100% COTTON WOVEN FABRIC BASE | 425 | 0 |
| WOVEN FABRIC IMPREGNATED WITH: | | |
| AQUAPEL 360: 0.07% HOES 2746: 0.23% GLYOXAL: 0.17% | 10.3 | 9 |
| WOVEN FABRIC IMPREGNATED WITH: | | |
| AQUAPEL 360: 0.07% | 108 | 0 |
| WOVEN FABRIC IMPREGNATED WITH: | | |
| HOES 2746: 0.23% | 351 | 12 |

The woven fabric thus receives a good water repellency and resistance to grease simultaneously.

EXAMPLE 12

Measurements of the water uptake (COBB) and the resistance to grease and solvents (KIT TEST) are made on various woven fabrics impregnated with one and the same composition comprising the following, by weight per liter of solution:

AQUAPEL 360: 350 g

HOES 2746: 250 g

GLYOXAL: 150 g.

As the above solution is not equally retained by the various fibers described, the amounts fixed, as percentages by weight relative to the fabrics, are indicated as for the previous Examples.

It must consequently be concluded that the association of the three basic products forming the composition results in synergistic effects between the three constituents, confering a barrier effect towards solvents and oily and aqueous agents whilst at the same time preserving a high porosity to air which is unmodified or only slightly modified by the treatment. Thus it has been found that, before undergoing the step of impregnation with the composition, the treated base may already have been treated beforehand with a fluorinated agent responsible for the resistance to grease, without the final hydrophobicity property of the product being affected.

It is also found that the impregnating composition permits an overall improvement in the wet strength of the paper and the retention of printing inks on its surface because of the treatment. It must also be pointed out that, according to the amounts applied, subsidiary effects complementary to the barrier effects may be obtained.

The invention is not limited to the Examples described and illustrated, it being possible for various modifications to be made thereto without departing from the framework of the invention.

What is claimed is:

1. A treated paper of textile base which is resistant to water, oil and solvents, wherein the base is treated with a composition comprising, by weight of dry product relative to the base, (a) at least 0.03% of glyoxal, (b) at least 0.01% of a dimeric alkylketen, and (c) at least 0.002% of a fluorinated salt which is a diethanolamine salt of perfluoroalkyl ethyl phosphate.

2. A treated base according to claim 1 wherein the composition comprises at least 0.8% of glyoxal, at least 0.3% of the dimeric alkylketen, and at least 0.35% of the fluorinated salt.

3. A treated base according to claim 1 wherein the salt is a diethanolamine salt of perfluoro $C_{8-18}$ alkylethyl phosphate.

4. A treated base according to claim 1 wherein the dimeric alkylketen is chosen as a function of pH of the fluorinated salt.

5. A treated base according to claim 1 wherein the composition further comprises viscosity-improving agents, spreading agents, waxes, mineral fillers, antifoams, adjuvants, or mixtures thereof.

6. A base according to claim 1 which is a textile base.

7. A base according to claim 1 which is thoroughly bulk impregnated with the composition.

8. A base according to claim 7 which comprises natural or synthetic fibers, or a mixture thereof.

9. A base according to claim 1 which is a paper base.

10. A process for the treatment of a paper or textile base with a composition comprising, by weight of dry product relative to the base;

(a) at least 0.03% of glyoxal, (b) at least 0.01% of a dimeric alkylketen, and (c) at least 0.002% of a fluorinated salt which is a diethanolamine salt of perfluoroalkyl ethyl phosphate, which process comprises applying the composition to the base with the aid of an impregnating press.

11. A process according to claim 10 wherein the impregnating press is a size press, an impregnator or a roller system.

12. A process according to claim 10 which further comprises treating the base with a fluorinated agent to render the base resistant to grease prior to the impregnation step.

13. A process according to claim 10 wherein the composition comprises at least 0.8% of glyoxal, at least 0.3% of the dimeric alkylketen, and at least 0.35% of the fluorinated salt.

14. A process according to claim 10 wherein the salt is a diethanolamine salt of perfluoro $C_{8-18}$ alkyl ethyl phosphate.

15. A process according to claim 10 wherein the dimeric alkylketen is chosen as a function of pH of the fluorinated salt.

16. A process according to claim 10 wherein the composition further comprises viscosity improving agents, spreading agents, waxes, mineral fillers, antifoams, adjuvants or mixtures thereof.

17. A process according to claim 10 wherein the base is thoroughly bulk impregnated with the composition.

* * * * *